US005468367A

United States Patent [19]

Dickakian

[11] Patent Number: 5,468,367

[45] Date of Patent: Nov. 21, 1995

[54] ANTIFOULANT FOR INORGANIC FOULING

[75] Inventor: Ghazi Dickakian, Kingwood, Tex.

[73] Assignee: Exxon Chemical Patents Inc., Linden, N.J.

[21] Appl. No.: 197,507

[22] Filed: Feb. 16, 1994

[51] Int. Cl.[6] ..... C10G 9/16

[52] U.S. Cl. ..... 208/48 AA; 208/348

[58] Field of Search ..... 208/48 AA, 348; 210/699

[56] References Cited

U.S. PATENT DOCUMENTS

| | | | |
|---|---|---|---|
| 2,737,452 | 3/1956 | Catlin | 44/62 |
| 3,546,097 | 12/1970 | Tupper | 208/48 |
| 3,554,897 | 1/1971 | Slanley | 208/48 |
| 3,772,182 | 11/1973 | Hubbard | 208/48 AA |
| 4,915,845 | 4/1990 | Leighton | 210/701 |
| 5,080,801 | 1/1992 | Molter et al. | 210/700 |

*Primary Examiner*—Helane Myers
*Attorney, Agent, or Firm*—R. L. Graham

[57] ABSTRACT

A salt of polyacrylic acid having a molecular weight of between 1,000 and 50,000, preferably 1,000 to 5,000, is used to inhibit inorganic fouling in crude oil.

6 Claims, No Drawings

ANTIFOULANT FOR INORGANIC FOULING

BACKGROUND OF THE INVENTION

This invention relates generally to the treatment of crude oil streams to prevent fouling by inorganic materials. In one aspect, the invention relates to the prevention or reduction of inorganic fouling in crude oil heat exchangers using the salts of polyacrylic acid and its derivatives.

The fouling of refinery equipment by crude oil has long been recognized. Such fouling not only damages equipment and reduces the effectiveness of heat exchange equipment, but also adds expense to the operation in that frequent shutdown times may be required to remove the fouling deposits.

The fouling by crude oil at the heat exchanger upstream of the refinery distillation unit is particularly critical since the heat exchange tubes are generally small and cannot tolerate the buildup of solids.

Fouling may be due to a variety of causes, including fouling by asphaltenes, fouling by polymerization of olefins, and fouling by oxidation, and fouling by deposition of inorganic impurities in the crude. Antifoulants for crude oil are formulated to combat the type of fouling encountered. For example, a variety of polyamines are available for inhibiting asphaltene fouling (see U.S. Pat. No. 4,619,756, column 4). Nitroxide compounds and antipolymerization additives are available for treating monomers to prevent polymer fouling (see U.S. Pat. No. 4,670,131). Antioxidants such as phenylene diamine and phenolic antioxidants are available for combating oxidation fouling.

Very few antifoulants for use in crude oil streams have been developed specifically for combating fouling by inorganic materials. These materials are present as impurities in the water phase of crude oil and include salts, silica, alumina, and corrosion by-products,s etc. Upon passing through the heat exchangers of the refinery these materials deposit on the heat transfer surfaces, reducing the heat transfer efficiency and/or plugging the equipment. All crudes have some water present. Even after desalting, there may be a trace to 0.5 percent of water which contains the inorganic impurities.

Fouling by the inorganic impurities in crude oil has long been recognized, as evidenced by U.S. Pat. Nos. 3,546,097 and 3,776,835. U.S. Pat. No. 3,558,470 describes the problems of inorganic impurities as causing complexes with organic deposits and oxidize derivatives resulting in the deposition of these materials as oil insoluble polymers and complexes. This patent suggests the use of an ashless dispersant and a phosphite type of antioxidant-antipolymerant compound. U.S. Pat. No. 3,776,835 identifies inorganic salts as foulants in crude oil and suggests the use of certain amines and amides in a hydrogen environment.

Both of these solutions appear to address the problem of asphaltene and/or unsaturated olefin fouling and oxidation fouling, with the role of inorganic materials as being part of the complexes, polymers, and oxidation products.

SUMMARY OF THE INVENTION

Surprisingly, it has been discovered that by treating crude oil to specifically inhibit fouling by inorganic impurities, the fouling of the crude oil heat exchanger is greatly reduced. The antifoulant used in accordance with the present invention is a salt of polyacrylic acid or its derivatives having the following formula:

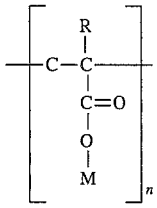

where

R is H or a $C_1$–$C_3$ alkyl group;

M is an alkaline earth metal, preferably Na and K, most preferably Na;

n is an integer ranging from about 10 to 200, preferably 15 to 100, most preferably 20 to 40.

The antifoulant is water soluble and is used at a treating rate of 5 to 1000 ppm, preferably 10 to 500 ppm, most preferably 20 to 200 ppm. The antifoulant preferably is introduced into the crude stream immediately upstream of the preheater of the distillation unit.

The inorganic antifoulant may be used alone or with other antifoulants designed to treat other forms of fouling. Such other antifoulants include amines such as polyisobutylene succinic anhydride-polyamine adduct (PIBSA-PAM), which is used to treat mainly organic fouling, such as that disclosed in U.S. Pat. No. 4,619,756.

DESCRIPTION OF THE PREFERRED EMBODIMENTS

The treatment of crude oil with salts of polyacrylic acid for the reduction of inorganic fouling in accordance with the present invention is preferably carried out with crude oils having a water content of less than 5%, preferably 2% or less. Thus, the method of the invention can be used with desalted crudes, or low water content crudes. The method of the invention thus is directed mainly at protecting the preheater of the distillation units where the flow tubes are relatively small, compared to downstream facilities. Unlike many of the prior art treatments, the treatment in accordance with the present invention is directed solely at reducing fouling by inorganic impurities in the crude oil. Such impurities include sodium chloride, magnesium chloride, calcium sulfate salts, and silica alumina.

The salts of the polyacrylic acids may have molecular weights ranging from 1,000 to 50,000, but preferably are within the range of 1,000 to 5,000 and most preferably between 1,800 to 3,600.

The salts of acrylic acid and its derivatives may have the following formula:

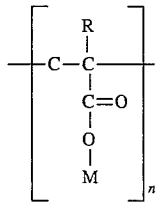

where

R is H or a $C_1$–$C_3$ alkyl group;

M is an alkaline earth metal, preferably Na and K, most preferably Na;

n is an integer ranging from about 10 to 200, preferably 15 to 100, most preferably 20 to 40.

The preferred treating compound includes the following polyacrylic acid derivatives: the $C_1$–$C_3$ alkyl substituted salts of polyacrylic acid such as salt of polymethacrylic acid (e.g. sodium methacrylate and potassium methacrylate polymers). The most preferred compound is sodium polyacrylate.

Polyacrylic acid derivatives which can be used in the present invention may be prepared by methods well known in the art. See, for example, Encyclopedia of Polymer Science and Engineering, Volume 1, pages 169,211 and 234, the disclosures of which are incorporated herein by reference.

Alternatively, many of these compounds are commercially available. A polymeric salt that has performed quite well is a product marketed by ALCO Chemical Company under trade designation AR910.

These polyacrylate salts are available in concentrations of 5 to 50 wt % in a suitable carrier such as water.

EXPERIMENTS

The following experiments demonstrate the significant role of inorganic fouling in the fouling of refinery equipment, specifically the preheater, and the effectiveness of treatments using the antifoulant described herein.

All experiments were carried out using a laboratory test apparatus known as the thermal fouling tester (TFT). The TFT is a modification of the Alcor Tester described in ASTM Vol. 50, D-3241. It is configured to allow measurement of the fluid temperature at the exit of the heat exchanger while the metal temperature of the heated tube is controlled. The test thus measures the change in temperature of a fluid which has been pumped across a heated metal surface. The outlet temperature is directly related to the heat transferred to the fluid. If fouling occurs, a deposit adheres to the heated metal surface and insulates a portion of the surface from the test fluid. The insulating deposit reduces the rate of heat transfer to the fluid and its temperature decreases. The rate of change in the fluid temperature is a measure of the rate of fouling.

The time over which temperature measurements are recorded was set at 3 hours. By doing this, the changes in temperatures of several fluids can be used as a measure of their relative fouling tendencies.

Experiment I Series

Three samples of a crude oil at various stages of dehydration were tested. The crude oil was highly aromatic which exhibited little or no asphaltene fouling. The crude oil samples were as follows:

Sample 1—crude oil emulsion

Sample 2—dewatered crude oil

Sample 3—desalted crude oil

The results are presented in Table I.

TABLE I

| | Crude Oil Emulsion | Dewatered Crude Oil | Desalted Crude Oil |
|---|---|---|---|
| Water Present (wt %) | 5 | 1–2 | 0.1–0.2 |
| Antifoulant | None | None | None |
| Antifoulant (PPM) | None | None | None |
| TFT Heater Temp (°F.) | 700 | 700 | 700 |
| Unit Pressure (psig) | 500 | 500 | 500 |
| Test Time (min.) | 180 | 180 | 180 |

TABLE I-continued

| | Crude Oil Emulsion | Dewatered Crude Oil | Desalted Crude Oil |
|---|---|---|---|
| Oil Flow (cc/min.) | 3.0 | 3.0 | 3.0 |
| Thermal Fouling (ΔT, °F.) | 44 | 19 | 0.00 |

The Table I data demonstrate that inorganic fouling is present and that the fouling appears to be due to the presence of water.

Experiment II Series

Additional TFT tests were run to determine the effect of the use of the polyacrylate antifoulant on the same crude used in Experiment I. The raw crude had 20–30 pounds of salt per 1000 barrels of crude. The antifoulant was ALCO's AR910 (sodium polyacrylate); MW of 2000–3300 and 28% active in water.

Tests were run varying the amount of the antifoulant. The results of these tests are presented in Table II.

TABLE II

| | | | |
|---|---|---|---|
| Antifoulant | None | Yes | Yes |
| Active Antifoulant (PPM) | None | 250 | 50 |
| Heater Metal Temp. (°F.) | 450 | 450 | 450 |
| Liquid Temp °F.) | 404 | 373 | 402 |
| Unit Pressure (psig) | 550 | 550 | 550 |
| Oil Flow (cc/min.) | 6 | 6 | 6 |
| Test Time (min.) | 180 | 180 | 180 |
| Thermal Fouling (ΔT, °F.) | 30 | 8 | 12 |

The above laboratory experiments clearly demonstrate the effectiveness of the use of the polyacrylate antifoulant in mitigating the effects of inorganic fouling. Additional experiments were carried out in a refinery which experienced severe fouling in the preheater of the distillation unit. The crude oil was raw dewatered crude oil and had a salt content of 200 per thousand barrels and filterable solids of 300 to 500 PPM based on ASTM D 4807-88. Filterable solids is a measure of the presence of inorganic material. When filterable solids exceed 150 ppm, fouling becomes a serious problem.

The antifoulant (AR 910) was injected upstream of the preheater at a rate of about 12.5 ppm. The treatment was continued for 60 days without plugging. This increased the run time of the preheater by 200%. This test demonstrated that the present invention can be used in crude oil that has not been desalted. In fact, the present invention may delay or avoid the need for desalting.

What is claimed is:

1. A method of treating a crude oil containing no more than 5 wt. % water to inhibit inorganic fouling which comprises (a) introducing into the crude oil an effective amount of a water soluble antifoulant having the following formula:

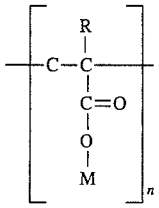

where

R is selected from the group consisting of H and C;

M is an alkaline earth metal;

n is an integer ranging from 10 to 200; and (b) passing the crude oil containing the antifoulant through a preheater of a distillation unit, wherein the preheater is operated at a temperature of between 300° to 500° F.

2. The method of claim 1 wherein the concentration of the antifoulant in the crude oil is from 5 to 1000 ppm.

3. The method of claim 1 wherein the antifoulant is a sodium salt of polyacrylic acid.

4. The method of claim 3 wherein n ranges from 15 to 100.

5. The method of claim 4 wherein n ranges from 20 to 40.

6. The method of claim 1 wherein the crude contains more than 150 ppm of filterable solids based on ASTM Test 4807-88.

* * * * *